United States Patent [19]

Ullmann

[11] Patent Number: 4,878,888

[45] Date of Patent: Nov. 7, 1989

[54] PROCESS AND APPARATUS FOR SEVERING AND SUBSEQUENTLY STACKING FLAT ARTICLES MADE OF PLASTIC FILM AND PREFERABLY CONSISTING OF DOUBLE BAGS

[75] Inventor: Klaus Ullmann, Uplengen, Fed. Rep. of Germany

[73] Assignee: Windmoller & Holscher, Lengerich, Fed. Rep. of Germany

[21] Appl. No.: 114,919

[22] Filed: Oct. 30, 1987

[30] Foreign Application Priority Data

Nov. 4, 1986 [DE] Fed. Rep. of Germany ..... 3637491

[51] Int. Cl.[4] ..... B31B 1/64

[52] U.S. Cl. ..... 493/204; 493/227

[58] Field of Search ..... 493/189, 194, 196, 204, 493/223, 227, 241

[56] References Cited

U.S. PATENT DOCUMENTS

| | | | |
|---|---|---|---|
| 3,805,683 | 4/1974 | Hook | 93/33 H |
| 4,529,114 | 7/1985 | Casper et al. | 225/100 |
| 4,657,528 | 4/1987 | Achelpohl et al. | 493/204 |
| 4,699,607 | 10/1987 | Lambrecht | 493/204 |

FOREIGN PATENT DOCUMENTS

| | | |
|---|---|---|
| 2244495 | 3/1971 | Fed. Rep. of Germany . |
| 3049142 | 7/1982 | Fed. Rep. of Germany . |
| 3138221 | 7/1984 | Fed. Rep. of Germany . |

*Primary Examiner*—Eugene R. Laroche
*Assistant Examiner*—Robert J. Pascal
*Attorney, Agent, or Firm*—Fleit, Jacobson, Cohn, Price, Holman & Stern

[57] ABSTRACT

A process of severing and subsequently stacking web section is disclosed, which in their central portions are provided with locating holes and preferably consist of double bags which have been severed from a tubular or semitubular, continuous plastic film web and are closed by hot-wire welding and have opening-defining edges. The web sections are delivered by a delivering means preferably consisting of a so-called wicketer having pairs of inner and outer wicketer arms, which are arranged in a starlike array and rotate about a horizontal axis, the web sections are deposited by said delivering means in a stacking station into a stacking conveyor, which consists of endless tensile elements, which are trained around reversing pulleys or rollers and are intermittently driven and provided with upstanding stacking pins. The stacks formed by the web sections placed on the stacking pins are intermittently carried off by an intermittent advance of the tensile elements. The web sections or the tubular or semitubular continuous web have or has been perforated on or adjacent to the longitudinal center line of each web section or of the web. Only one tear-off perforation line is provided and is severed while the web sections are being transported by the delivery means or the wicketer arms and before the web sections are placed on the stacking pins. Said severing is effected in that the web sections are subjected to tension by or are beaten against a severing edge or a severing wire or the like.

6 Claims, 1 Drawing Sheet

PROCESS AND APPARATUS FOR SEVERING AND SUBSEQUENTLY STACKING FLAT ARTICLES MADE OF PLASTIC FILM AND PREFERABLY CONSISTING OF DOUBLE BAGS

BACKGROUND OF THE INVENTION

1. Field of the Invention

This invention relates to a process of severing and subsequently stacking web sections which in their central portions are provided with locating holes and preferably consist of double bags which have been severed from a tubular or semitubular, continuous plastic film web and are closed by hot-wire welding and have opening-defining edges, in which process the web sections are delivered by a delivering means preferably consisting of a so-called wicketer having pairs of inner and outer wicketer arms, which are arranged in a starlike array and rotate about a horizontal axis, and the web sections are deposited by the delivering means in a stacking station onto a stacking conveyor, which consists of endless tensile elements, which are trained around reversing pulleys or rollers and are intermittently driven and provided with upstanding stacking pins, the stacks formed by the web sections placed on the stacking pins are intermittently carried off by an intermittent advance of the tensile elements, and the web sections or the tubular or semitubular continuous web have or has been perforated on or adjacent to the longitudinal center line of each section or of the web.

The invention relates also to apparatus for carrying out the process described first hereinbefore, comprising a so-called wicketer, which in each of a plurality of parallel planes which are at right angles to and contain the axis of rotation of the wicketer which comprises four wicketer arms forming a star-shaped array, wherein the star-shaped arrays formed by the inner wicketer arms extending in the two innermost ones of the planes define a gap between them.

2. Description of the Prior Art

In a process which is known from Published German Application No. 31 38 221, the double bags which have been severed from a tubular web and closed by transverse seam welds are deposited on stacking plates, which are carried by endless chains and are provided with two rows of stacking pins on respective sides of their longitudinal center plane. The stacking pins serve to receive the bags. The stacks of bags are separated by a heated cutter, which is adapted to be lifted and lowered and by which the stacks disposed in the stacking station are severed between the rows of stacking pins in an operation in which the stacking plate constitutes an abutment cooperating with the cutter. As the stacking plates constitute the abutments for the heated cutters, the plates must be relatively large and heavy. For this reason the known apparatus is relatively expensive because the endless chains must be provided with stacking plates which have the same spacing as the stacks to be transported by the plates and which must be adapted to act as abutment plates for cooperation with the cutter. In the process that has been described with reference to FIG. 5 of Published German Application No. 31 38 221 the locating holes are disposed in a central strip-shaped central area, which is laterally defined by perforation lines and which is bisected by the cut performed to cut the stacks apart.

Published German Application No. 22 44 495 discloses stacks which consist of double bags which are held together only by a central perforation line and which are blocked to each other by hole-defining seam welds adjacent to said perforation lines. The double bags are not separated from each other before they are stacked but only as they are torn from the stack of double bags.

Published German Application No. 30 49 142 discloses a process of making bags, which are joined by perforation lines from a two-ply web, in which the bags are joined by perforation lines and from which pairs of bags are torn when they have been made. Grippers which laterally grip each pair of bags to be torn off are provided for tearing each pair of still connected bags from the web and for stacking said pairs of bags. Said grippers are secured to the ends of spokelike arms, which are arranged in pairs and mounted on rotatably mounted hubs, which are operatively connected to drive means. In that known apparatus each pair of still connected bags are torn off by grippers which are mounted on revolving arms. But the still connected bags of each pair are not separated once more as they are transferred from the web onto the stack.

SUMMARY OF THE INVENTION

It is an object of the invention to provide a process which is of the kind described first hereinbefore and which permits separate stacks to be made from the centrally cut apart web sections or double bags in a simpler manner and with simpler means.

In a process of the kind described first hereinbefore that object is accomplished in that only one tear-off perforation line is provided and said tear-off perforation line is severed while the web sections are being transported by the delivery means or the wicketer arms and before the web sections are placed on the stacking pins and the severing is effected in that the web sections are subjected to tension by or are beaten against a severing edge or a severing wire or the like.

In the process in accordance with the invention each web section or double bag is severed adjacent to its longitudinal center line as the web section or double bag is transported to the stacking station by the delivering means or the wicketer. As a result, centrally severed web sections or individual bags severed from the double bags are stacked on the stacking pins to form stacks consisting of a predetermined number of pieces. The process in accordance with the invention can be performed much more simply with a lower expenditure because it is no longer necessary to sever the complete stacks by separate severing means which comprise a sufficiently strong stacking conveyor as an abutment for the cutter used to sever the stacks placed on the stacking pins. There are no separate means for severing the stacked web sections or double bags so as to form individual stacks but a tearing rod or the like is provided to sever the individual web sections or double bags and involves only a low capital expenditure.

The apparatus for carrying out the process described first hereinbefore is characterized in that a tearing wire, tearing rod, tearing plate or tearing cutter blade is mounted on the machine frame and extends into the gap between the inner wicketer arms in a plane that is at right angles to the axis of rotation of the wicketer in the angular range through which the web sections are transported by the wicketer arms.

The tearing wire or the like is suitably secured to at least one crosspiece, which is secured to the machine frame and extends outside the cylindrical surface which envelops the wicketer arms. To permit an adjustment of the tearing wire or the like, the same may be displaceably secured by means of clamping members to crosspieces which are parallel to the axis of rotation of the wicketer. Two of said crosspieces are desirably provided above and below the wicketer, respectively, and hold the tearing wire or the like between them.

In the direction of conveyance, the tearing wire or the like preferably succeeds the axis of rotation of the wicketer in the direction of conveyance and extends above the plane in which the web sections or the web are or is fed to the wicketer, and the tearing wire or the like is preferably inclined relative to the feeding plane, opposite to the direction of conveyance, at an angle between 30 and 60 degrees. As a result, the tear-off perforation line to be severed is progressively moved over the tearing wire or the like in contact therewith and is progressively severed.

For a virtually progressive tearing along the tear-off perforation line in conjunction with a minimum stressing of the workpieces, the tearing wire may be arcuately curved.

DETAILED DESCRIPTION OF THE PREFERRED EMBODIMENT

Figure 1:
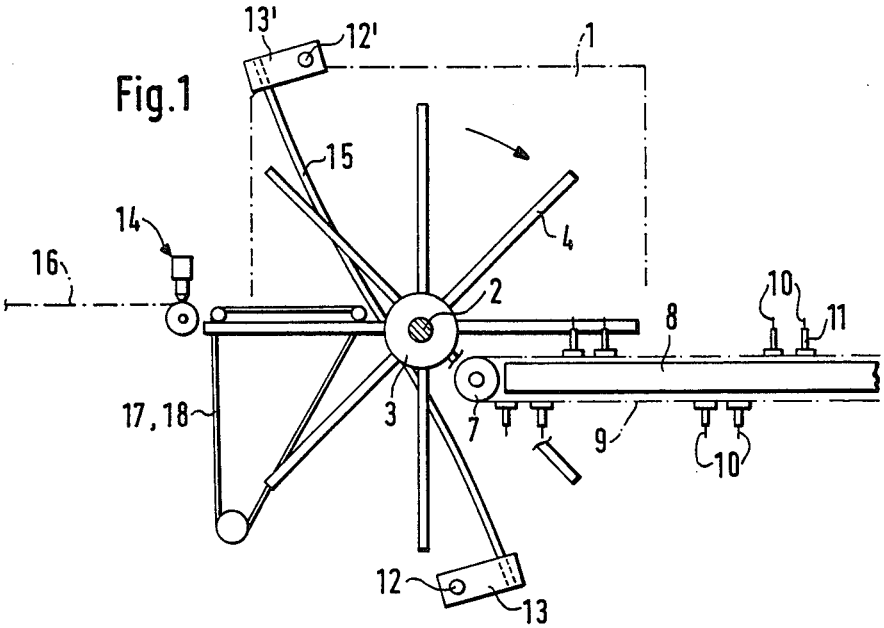
FIG. 1 is a side elevation showing the stacking apparatus comprising a wicketer and a hot-wire welding apparatus for severing web sections or double bags from a web and for closing said web sections or double bags.

An illustrative embodiment of the invention will be explained more in detail hereinafter with reference to the drawing.

A shaft 2 is rotatably mounted in side frames of a machine frame 1, which is indicated in phantom. The shaft 2 is operatively connected to drive means, not shown. A hub 3 is secured to the shaft 2 and carries so-called wicketer arms 4, 4' in star-shaped arrays. In known manner the wicketer arms 4, 4' are provided with gripping means or vacuum cups. A vacuum is applied to each vacuum cup through a suction line and a rotary lead-through so that web sections can be sucked by the vacuum cups. As is apparent from FIG. 2, the wicketer arms comprise outer arms 4 and inner arms 4'. The star-shaped arrays formed by the inner arms 4' define a gap between them. Each star-shaped array consisting of outer or inner arms 4 or 4' secured to the hub extends in a plane which contains and intersects the axis of rotation of the wicketer.

Figure 2:
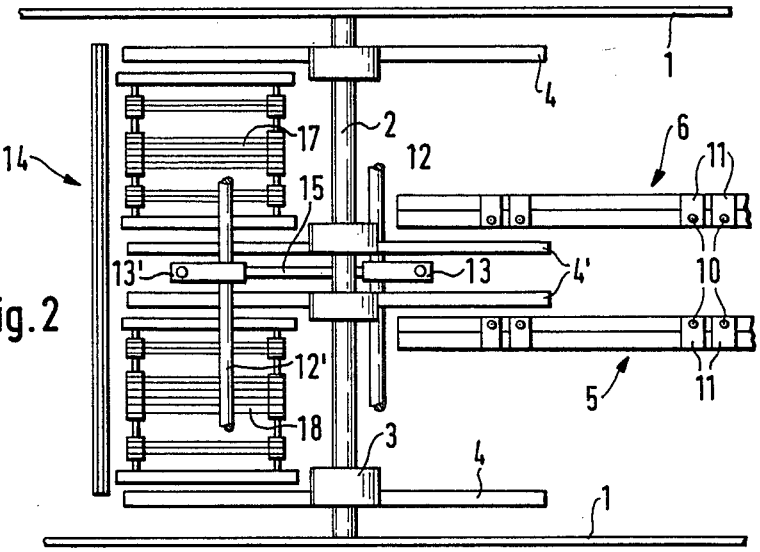
FIG. 2 is a top plan view showing the apparatus of FIG. 1.

Two stacking conveyors 5, 6 are disposed on the right-hand side of the wicketer viewed as in FIGS. 1 and 2 and extend between adjacent arrays of outer and inner wicketer arms 4, 4'. Each of said stacking conveyors comprises an endless tensile element 9, which is trained around reversing pulleys 7 and runs on a guide beam 8. Pairs of stacking pins 10 are secured to each of said tensile elements. The spacing of said pairs of pins equals the spacing of the stacks to be formed. Sleeves 11 provided with end flanges have been fitted on the stacking pins and can be removed from the pins 10 together with the completed stack so that the same will be held together by said sleeves and the stack can then be closed by means of a flanged tubular member which is forced into the sleeve.

The stacking belts 5, 6 extend into the space between adjacent arrays of outer and inner wicketer arms 4, 4' closely adjacent to the inner wicketer arms 4'.

Tubular crosspieces 12, 12' are secured in the side frames of the machine frame and extend parallel to the wicketer shaft 2. Clamping members 13, 13' are secured to said crosspieces 12, 12'. The ends of a tearing rod 15 are secured in the crosspieces 12, 12'. The tearing rod 15 extends into the annular gap between the inner wicketer arms 4'.

On the left-hand side of the apparatus viewed as in FIGS. 1 and 2, a transverse hot-wire welding device 14 is mounted in the machine frame and operated to sever web sections or double bags from a tubular or semitubular web that comes from a bagmaking or processing machine, and to close said web sections or double bags, which are subsequently taken over and stacked by the wicketer arms.

Two short conveyors 17, 18 consisting each of an endless belt are provided between the hot-wire welding station 14 and the wicketer shaft and between adjacent arrays of outer and inner wicketer arms 4 and 4'. Said conveyors 17, 18 constitute a support for the leading end of the web as it is advanced between the opened clamping jaws of the hot-wire welding station 14 so that the web section which has been severed and closed can be taken over and inverted by the wicketer arms and can be placed by them on the pins 10 or sleeves 11. The web 16 has been formed with a longitudinally extending, central tear-off perforation line. As the severed and welded web sections are transported and inverted by the wicketer arms and then placed on the stacking pins 10, the web sections engage the tearing wire 15 and are thus severed along their central tear-off perforation line. On both sides of the central tear-off perforation line the web 16 is formed with pairs of stacking holes. The spacing of the stacking holes of each pair and the spacing of the pairs of stacking holes correspond to the spacing of the stacking pins 11 of each pair and to the spacing of the pairs of stacking pins, respectively. When the web sections have been centrally divided, their inner edge portions, which may constitute the open ends of bags, will be placed on the stacking pins 10 or the sleeves 11.

As the stacking belts 5, 6 are close to the inner wicketer arms 4', the stacked bags will hang down on the outside from the sides of the stacking conveyors 5, 6.

I claim:

1. A process of severing and subsequently stacking web sections which in their central portions are provided with locating holes, said process comprising:

delivering the web sections by a delivering means including a wicketer having pairs of inner and outer wicketer arms, which are arranged in a star-like array and rotate about a horizontal axis, and the web sections are deposited by said delivering means in a stacking station onto a stacking conveyor, which includes endless tensile elements, which are trained around reversing elements and are intermittently driven and provided with upstanding stacking pins, the stacks formed by the web sections placed on the stacking pins are intermittently carried off by an intermittent advance of the tensile elements, and the web sections having been perforated on or adjacent to the longitudinal center line of each section of the web, severing said perforation line while the web sections are being transported by the delivery means and before the web sections are placed on the stacking pins and said severing is effected in that the web sections are subjected to a severing force.

2. Apparatus for carrying out the process of severing and stacking web sections, said apparatus comprising: a wicketer, which in each of a plurality of parallel planes which are at right angles to and contain the axis of rotation of the wicketer includes four wicketer arms forming a star-shaped array, wherein the star-shaped arrays formed by inner wicketer arms extending in the two innermost ones of said planes define a gap between them, and a tearing element is mounted on a machine frame and extends into the gap between the inner wicketer arms in a plane that is at right angles to the axis of rotation of the wicketer in the angular range through which the web sections are transported by the wicketer arms.

3. Apparatus according to claim 2, wherein the tearing element is secured to at least one crosspiece, which is secured to the machine frame and extends outside a cylindrical surface which envelops the wicketer arms.

4. Apparatus according to claim 3, wherein the tearing element is displaceably secured by means of clamping members to crosspieces which are parallel to the axis of rotation of the wicketer.

5. Apparatus according to claim 2, two of said crosspieces are provided above and below the wicketer, respectively.

6. Apparatus according to claim 2, wherein the tearing element succeeds the axis of rotation of the wicketer in the direction of conveyance and extends above the plane in which the web sections are fed to the wicketer, and the tearing element is inclined relative to the feeding plane, opposite to the direction of conveyance, at an angle between 30 and 60 degrees.

* * * * *